US005235783A

United States Patent [19]

Huber et al.

[11] Patent Number: 5,235,783

[45] Date of Patent: Aug. 17, 1993

[54] REVOLVING DOOR

[76] Inventors: Jacob R. A. Huber; Erik J. Huber, both of Ambachtstraat 4, NL-Edam, Netherlands

[21] Appl. No.: 847,045

[22] PCT Filed: Oct. 22, 1990

[86] PCT No.: PCT/NL90/00158

§ 371 Date: Apr. 14, 1992

§ 102(e) Date: Apr. 14, 1992

[87] PCT Pub. No.: WO91/06737

PCT Pub. Date: May 16, 1991

[51] Int. Cl.[5] ..... E05D 15/02

[52] U.S. Cl. ..... 49/42; 49/25; 49/28

[58] Field of Search ..... 49/42, 43, 44, 45, 25, 49/28; 109/8

[56] References Cited

U.S. PATENT DOCUMENTS

| | | | |
|---|---|---|---|
| Re. 30,719 | 8/1981 | Mills | 49/25 X |
| 4,060,935 | 12/1977 | Miller et al. | 49/42 X |
| 4,295,297 | 10/1981 | Carroll et al. | 49/42 |
| 4,697,383 | 10/1987 | Hagiwara | 49/25 |
| 4,785,580 | 11/1988 | Olesen | 49/44 |

*Primary Examiner*—Philip C. Kannan

*Attorney, Agent, or Firm*—Harrison & Egbert

[57] ABSTRACT

A revolving door with a passage space (3) enclosed by a housing (1) in which the door panels (4) are mounted onto a central rotatable support (5). One or more sensors (6) are present which, at the presence of an object within a certain distance of a door panel (4) may emit a signal. The signal serves to actuate a controlling device so as to operate the drive of the revolving door.

4 Claims, 1 Drawing Sheet

REVOLVING DOOR

TECHNICAL FIELD

The present invention relates to revolving doors, generally. More particularly, the present invention relates to detection devices for controlling the rotation of a revolving door.

BACKGROUND ART

Such a revolving door is generally known.

This known revolving door has the drawback, that when the revolving door has been put into rotation by a drive, a door panel might collide with a person or an object within the passage space.

It is an object of the invention to eliminate this drawback of the known revolving door.

SUMMARY OF THE INVENTION

The revolving door according to the invention thereto is characterized in that one or more sensors are present, these sensors, in the presence of an object within a certain distance of a door panel, may emit a signal, by means of which the drive of the door can be operated by a controlling device.

With the door according to the invention it will in this way be possible to stop the door when an object within the passage space is approached too closely by a door panel.

In an embodiment of the revolving door according to the invention, the sensors are ultrasonic sensors, which are placed generally centrally in the door and are directed along one or more door panels, in such a way that by means of the signal reflected by an object the drive of the door can be operated by the controlling device.

In a preferred manner, the ultrasonic sensors could be placed on the central support, and the sensed area, as viewed in the rotating direction of the door, can be situated in front of a door panel.

In order to have the controlling device, by means of which the drive of the door can be operated, remain unaffected by unwanted reflections, the length of the sensed area of a sensor is limited to a maximum value. Only those reflection signals can be introduced into the controlling device having a reflection time (i.e. the time passed between the transmittal of the ultrasonic signal and the reception of its reflection) below an adjustable maximum value.

In an embodiment of the revolving door according to the invention the controlling device is an electrical or electronic circuit with a filter, by means of which the introduction of a reflected signal with a reflection time longer than the adjustable maximum value is prevented.

By this measure the length of the sensored area can be adjusted to a certain value in a very accurate way.

In a further embodiment of the present invention, the pass value of the filter is adjustable. The pass value of the filter controls the length of the sensed area. The pass value of the filter associated with the sensor can be increased such that the pass value is greater when the door panel approaches a passage opening. By this measure a greater safety is achieved against collision of the door panels with persons that approach the passage opening.

According to a further feature of the revolving door according to the invention the pass value of the filter is adjustable by operating one or more switches, which can be actuated by the rotation of the door. These switches can be placed in different ways in the revolving door according to the invention. In an embodiment of the revolving door according to the invention the switches are mounted onto a door panel and/or the central support and cooperate with cams or similar operating apparatus fixedly placed with respect thereto. These switches may be magneto-switches and the cooperating elements can be magnets.

The invention will be illustrated with reference to a drawing of an example of an embodiment of the invention.

BRIEF DESCRIPTION OF THE DRAWINGS

In the drawing of FIG. 1 a horizontal section of the revolving door is schematically shown.

DETAILED DESCRIPTION OF THE INVENTION

Figure 1:
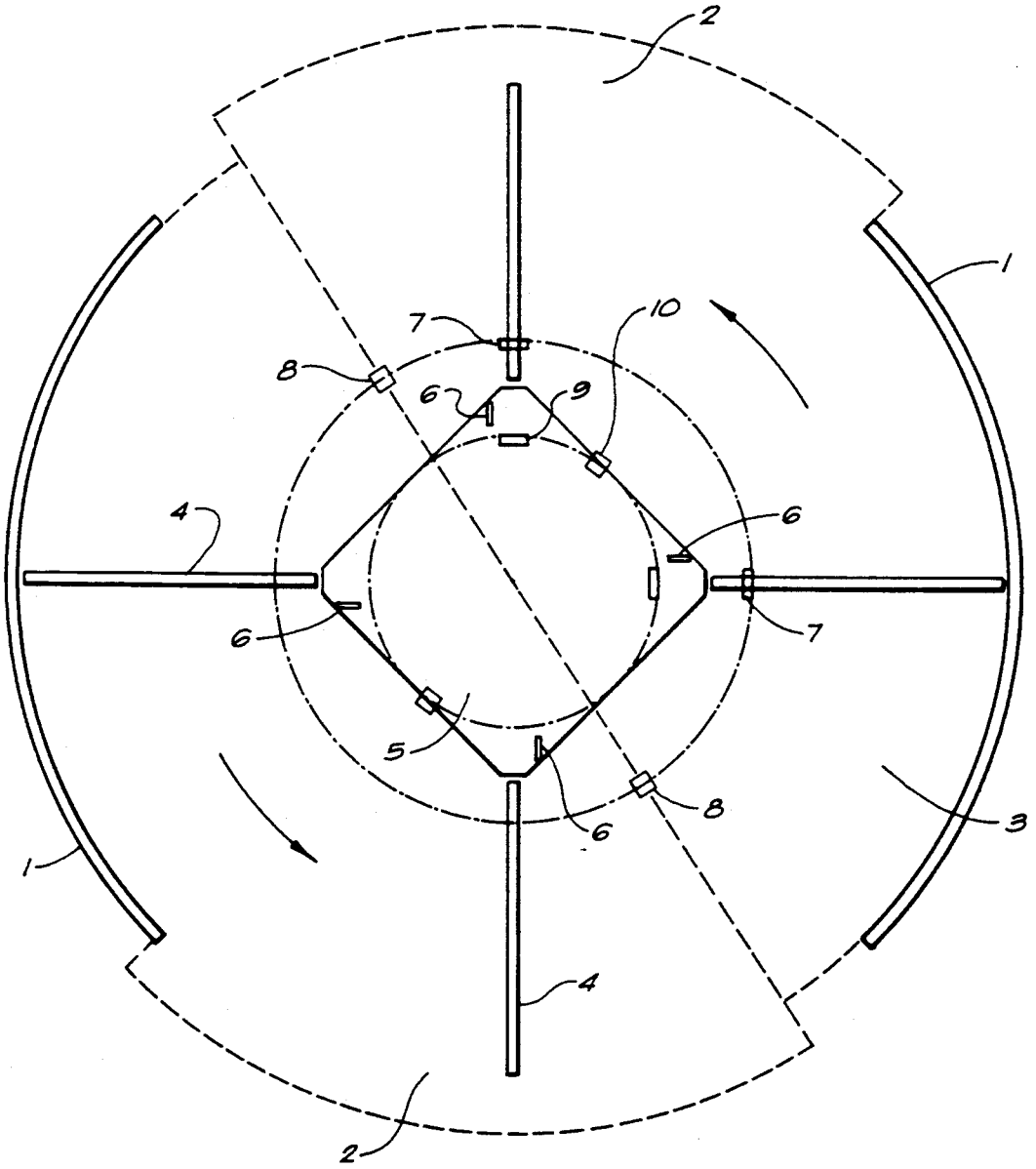

As the drawing of FIG. 1 shows, the revolving door comprises a housing 1, which encompasses, with the exception of two diametrically opposed passage openings 2, the passage space 3, within which the four door panels 4 are mounted onto the central rotatable support 5, which can be operated.

As viewed in the rotating direction, the ultrasonic sensors 6 are mounted onto the central support 5. The sensors 6 are directed toward and along the front sides of the door panels 4. The sensors 6 are used for actuating a controlling device (not shown) so as to control the drive of the revolving door. The sensors 6 are directed so as to transmit and receive an ultrasonic signal adjacent the front sides of the door panels 4. As the door panel 4 approaches too closely to an object or person within the path of rotation of the panel 4, the interrupted ultrasonic signal will cause the drive of the revolving door to slow or stop the door.

Further, magneto-switches 7 are mounted on two of the door panels 4. These magneto-switches 7 may be operated by the magnets 8 to decrease the length of the sensed area of the sensors 6 to within and close to the wall of the housing 1.

Magneto-switches 9 can be mounted to the central support 5 such that the magnets 10 can actuate the magneto-switches 9 so as to increase the length of the sensed area at the location of the passage opening 2. The magnets 10 serve to provide an actuation signal to the magneto-switches 9 of the path of rotation of the door panels 4.

We claim:

1. A revolving door comprising:

a housing encompassing a passage space, said housing having at least two diametrically opposed passage openings extending into said passage space;

a plurality of door panels mounted onto a central rotating support, said plurality of door panels defining compartments therebetween, said door panels and said central rotating support positioned in said passage space; and sensor means positioned generally centrally within said passage space, said sensor means being directed along at least one of said door panels, said sensor means for controlling the drive of the door panels, said sensor means emitting a signal for a desired maximum length, said desired length of said signal defining a sensed area, said sensor means receiving reflections of said signal, said sensor means only passing said reflections having a reflection time below an adjustable maximum value, said reflection time being the time between the emission of the signal and the reception of the reflection of the signal.

2. The revolving door of claim 1, said sensor means having a filter means therein, said filter means for preventing the passing of signals having a reflection time longer than said adjustable maximum value.

3. The revolving door of claim 2, said filter means having a pass value corresponding to the length of said sensed area, said sensed area being of variable length, said sensed area being less than a distance between said housing and said sensor means when said sensor means is directed toward a wall of said housing, said sensed area having a greater value when said sensor means is directed toward the passage openings of said housing.

4. The revolving door of claim 3, said pass value of said filter means being variable by switches actuated by a rotation of said door panels.

* * * * *